US011037542B2

(12) United States Patent
Okamoto

(10) Patent No.: US 11,037,542 B2
(45) Date of Patent: Jun. 15, 2021

(54) KEYBOARD DEVICE FOR ELECTRONIC KEYBOARD INSTRUMENT

(71) Applicant: KAWAI MUSICAL INSTRUMENTS MANUFACTURING CO., LTD., Shizuoka (JP)

(72) Inventor: Seiji Okamoto, Shizuoka (JP)

(73) Assignee: KAWAI MUSICAL INSTRUMENTS MANUFACTURING CO., LTD., Hamamatsu (JP)

( * ) Notice: Subject to any disclaimer, the term of this patent is extended or adjusted under 35 U.S.C. 154(b) by 7 days.

(21) Appl. No.: 16/783,809

(22) Filed: Feb. 6, 2020

(65) Prior Publication Data

US 2020/0265818 A1 Aug. 20, 2020

(30) Foreign Application Priority Data

Feb. 19, 2019 (JP) ..... JP2019-027194

(51) Int. Cl.
*G10H 1/34* (2006.01)
*G10C 3/18* (2006.01)

(52) U.S. Cl.
CPC ..... *G10H 1/346* (2013.01); *G10C 3/18* (2013.01); *G10H 2220/221* (2013.01)

(58) Field of Classification Search
CPC ..... G10H 1/346; G10H 1/344; G10H 1/34; G10H 2220/221; G10H 1/32; G10H 2220/285; G10H 2220/275; G10H 2220/265; G10C 3/12; G10C 3/18; G10C 5/10
See application file for complete search history.

(56) References Cited

U.S. PATENT DOCUMENTS

| | | | | |
|---|---|---|---|---|
| 8,766,076 | B2 | 7/2014 | Ishida | |
| 2011/0011249 | A1* | 1/2011 | Shimoda | G10C 3/12 84/744 |
| 2011/0179935 | A1* | 7/2011 | Ishida | G10H 1/346 84/20 |
| 2017/0278498 | A1* | 9/2017 | Suzuki | G10H 1/34 |
| 2020/0005747 | A1* | 1/2020 | Nishida | G10H 1/46 |
| 2020/0027432 | A1* | 1/2020 | Yamamoto | G10H 1/346 |
| 2020/0043452 | A1* | 2/2020 | Yamamoto | G10C 3/18 |
| 2020/0088258 | A1* | 3/2020 | Tanoue | F16F 1/376 |
| 2020/0111465 | A1* | 4/2020 | Sato | G10C 3/125 |
| 2020/0126527 | A1* | 4/2020 | Sato | G10H 1/0008 |
| 2020/0265818 | A1* | 8/2020 | Okamoto | G10H 1/346 |

FOREIGN PATENT DOCUMENTS

JP 5624772 B2 10/2014

* cited by examiner

*Primary Examiner* — Marlon T Fletcher
(74) *Attorney, Agent, or Firm* — Westman, Champlin & Koehler, P.A.

(57) ABSTRACT

A pressing surface of a hammer and a to-be-pressed surface of a key switch have relatively-concaved shapes in a longitudinal direction of the hammer. When a switch body is pressed by the hammer, an inclination caused by an overall curvature of the switch body that results from the fact that the switch body is pressed by the hammer from an oblique direction is canceled by an inclination of the switch body caused by partial compression and deformation that results from the relatively-concaved shapes, so that movable contacts in the switch body frontally face stationary contacts and come into contact with the stationary contacts, respectively.

8 Claims, 7 Drawing Sheets

KEYBOARD DEVICE FOR ELECTRONIC KEYBOARD INSTRUMENT

CROSS-REFERENCE TO RELATED APPLICATIONS

This non-provisional application claims priority to Japanese Patent Application No. 2019-027194, filed on Feb. 19, 2019; the contents of which are hereby incorporated by reference in their entireties.

TECHNICAL FIELD

The present invention relates to a keyboard device for an electronic keyboard instrument, and, more particularly, relates to a keyboard device for an electronic keyboard instrument in which a contact state is excellent when a plurality of movable contacts of a plurality of switches come into contact with stationary contacts, respectively, in a key switch to detect key depression information when a key is depressed and in which an electric touch sensing operation is stabilized.

BACKGROUND ART

A keyboard device for an electronic keyboard instrument includes a plurality of keys and a key touch sensing configuration that detects key depression information when a key is depressed. The electric key touch sensing configuration includes a key switch and a keyboard mechanism movable portion that is composed of hammers each of which is provided for each key and means for rotatably supporting the hammers.

The key switch includes a switch body formed in a hollow dome shape and a plurality of switches disposed in the switch body, and each of the switches has a movable contact and a stationary contact.

When the hammer rotates in response to depression of the key, the switch body of the key switch is pressed in response to that rotation, and the movable contacts of the switches in the switch body come into contact with the stationary contacts, respectively. A detection signal indicating this contact therebetween is detected, and, based on the presence or absence of the detection signal, it is possible to detect the depression of the key, and, based on a time difference between detection signals, it is possible to detect the depression speed of the key depression and the like.

FIG. 5 is a descriptive view showing a positional relationship between a hammer and a key switch in a conventional key touch sensing configuration. FIG. 6 is a descriptive view showing a positional relationship between a hammer and a key switch in a configuration in which the hammer has ribs. In these drawings, the positional relationship is shown as a positional relationship between a hammer and a key switch with respect to one key.

As shown in FIG. 5 and FIG. 6, the key touch sensing configuration includes a hammer 2 and a key switch 3 that are provided for each key. The hammer 2 has a pressing surface 2*b* that presses the key switch 3 in response to its rotation, and the key switch 3 has a to-be-pressed surface 3*b* that is pressed by the hammer 2. As shown in FIG. 6, in the configuration in which the hammer 2 has the ribs 2*d*, a surface formed by connecting front ends of the ribs 2*d* together is a pressing surface.

Patent Document 1 discloses a keyboard device for an electronic keyboard instrument in which a to-be-pressed surface of a key switch has the same shape as a pressing surface of a hammer, and movable contacts of a plurality of switches in a switch body come into contact with stationary contacts, respectively, and after that, when the rotation of the hammer is ended, the pressing surface of the hammer coincides in direction with the to-be-pressed surface of the key switch.

CITATION LIST

Patent Literature

Patent Document 1: JP 5624772 B (JP 2011-150245 A)

SUMMARY OF INVENTION

Problem to be Solved by Invention

In the conventional key switch, its to-be-pressed surface is designed so as to have the same shape as the pressing surface of the hammer. Such a design is made to enable the hammer to press the key switch in a vertical direction after the pressing surface of the hammer comes into close contact with the to-be-pressed surface of the key switch in response to the rotation of the hammer.

However, in general, the hammer rotates while following a circular arc locus centering on a fulcrum that supports the hammer, and therefore the pressing surface of the hammer frontally faces the to-be-pressed surface of the key switch only for a moment, and therefore the hammer presses the key switch in the vertical direction only for a moment.

When the hammer rotating while following the circular arc locus begins to come into contact with the key switch, the hammer is brought into contact therewith obliquely from one side of the key switch, and presses the key switch in response to its rotation from the oblique direction. Because of this pressing from the oblique direction, the switch body of the key switch curves as a whole and is inclined, and, as a result, the movable contacts of the switches in the switch body obliquely come into contact with the stationary contacts, respectively.

FIG. 7 is an enlarged, sectional side view that shows a hammer, a key switch, and its peripheral portion of a conventional keyboard device and that shows a state when the hammer rotating while following a circular arc locus begins to come into contact with the key switch. FIG. 8 is an enlarged, sectional side view that shows a hammer, a key switch, and its peripheral portion of a conventional keyboard device and that shows a state when a switch body pressed by the hammer curves as a whole and is inclined, and hence movable contacts of the switches in the switch body obliquely come into contact with stationary contacts, respectively.

As shown in FIG. 7 and FIG. 8, the hammer 2 includes a hammer body 2*a* and a switch pressing portion 2*c*, and the switch pressing portion 2*c* has a pressing surface 2*b*. The key switch 3 has a hollow dome structure that includes a hollow dome-shaped switch body 3*a* that is downwardly open, and the switch body 3*a* has a to-be-pressed surface 3*b*. Here, the to-be-pressed surface 3*b* of the key switch 3 has the same shape as the pressing surface 2*b* of the hammer 2.

Additionally, a plurality of switches 3*c*-1 to 3*c*-3 are disposed in the switch body 3*a*, and each of the switches 3*c*-1 to 3*c*-3 has a movable contact and a stationary contact. The key switch 3 is attached to a printed circuit board (substrate).

The hammer 2 rotates while following a circular arc locus that centers on its fulcrum, and therefore, when the hammer 2 begins to come into contact with the key switch 3, the hammer 2 is brought into contact therewith obliquely from one side thereof. FIG. 7 shows a state at this time.

The hammer 2 rotating while following the circular arc locus presses the switch 3 from an oblique direction in response to its rotation, and therefore the switch body 3*a* of the key switch 3 curves as a whole. Hence, the movable contacts of the switches 3*c*-1 to 3*c*-3 in the switch body 3*a* obliquely come into contact with stationary contacts, respectively. FIG. 8 shows a state at this time.

A contact area is small when the movable contacts of the switches 3*c*-1 to 3*c*-3 obliquely come into contact with the stationary contacts, respectively, and therefore a problem resides in that the contact resistance is large, and, as a result, an electric touch sensing operation is destabilized.

The keyboard device for an electronic keyboard instrument disclosed by Patent Document 1 is to stabilize contact between a plurality of movable contacts and a plurality of stationary contacts, and although this is configured so that the movable contact is no longer deviated or disconnected from the stationary contact after making contact therebetween by eliminating the inclination of the switch body when the hammer reaches a maximal rotational amount and stops its rotation, yet the contact state between the movable contact and the stationary contact has been ignored, i.e., the fact that the movable contacts in the switch body obliquely come into contact with the stationary contacts, respectively, when the key switch is pressed from an oblique direction by means of the hammer rotating while following a circular arc locus has been ignored.

The present invention aims to solve the aforementioned problem and provide a keyboard device for an electronic keyboard instrument in which a contact state is excellent when a plurality of movable contacts of a plurality of switches in a switch body of a key switch depressed by a hammer rotating while following a circular arc locus come into contact with stationary contacts, respectively, and in which an electric touch sensing operation is stabilized.

Solution to Problems

To achieve the afore-mentioned object, the present invention has a feature in that a keyboard device for an electronic keyboard instrument, the keyboard device comprises a swingable key, a hammer that has a pressing surface having a predetermined shape and that rotates while following a circular arc locus in response to depression of the key, and a key switch to detect key depression information on the key, and the key switch comprises a substrate on which a plurality of stationary contacts are disposed, a hollow switch body that has a to-be-pressed surface, that is made of an elastic material, and that is attached to the substrate so as to cover the plurality of stationary contacts, and a plurality of movable contacts that are disposed inside the switch body, that respectively face the plurality of stationary contacts with mutually different intervals, and that respectively come into contact with the plurality of stationary contacts in order when the switch body is pressed by the hammer in response to depression of the key, wherein the pressing surface and the to-be-pressed surface have relatively-concaved shapes in a longitudinal direction of the hammer, and an inclination caused by an overall curvature of the switch body that results from the fact that the switch body is pressed by the hammer from an oblique direction is canceled by an inclination of the switch body caused by partial compression and deformation that results from the relatively-concaved shapes when the switch body is pressed by the hammer, so that the plurality of movable contacts frontally face the plurality of stationary contacts and come into contact with the plurality of stationary contacts, respectively.

Here, it is preferable that the pressing surface wholly come into close contact with the to-be-pressed surface before the plurality of movable contacts come into contact with the plurality of stationary contacts, respectively.

It is also preferable that the plurality of movable contacts are three or more in number, and the plurality of stationary contacts are three or more in number. The hammer may have ribs on a side of the switch body.

Effects of Invention

According to the first feature of the present invention, a keyboard device for an electronic keyboard instrument, the keyboard device comprises a swingable key, a hammer that has a pressing surface having a predetermined shape and that rotates while following a circular arc locus in response to depression of the key, and a key switch to detect key depression information on the key, and the key switch comprises a substrate on which a plurality of stationary contacts are disposed, a hollow switch body that has a to-be-pressed surface, that is made of an elastic material, and that is attached to the substrate so as to cover the plurality of stationary contacts, and a plurality of movable contacts that are disposed inside the switch body, that respectively face the plurality of stationary contacts with mutually different intervals, and that respectively come into contact with the plurality of stationary contacts in order when the switch body is pressed by the hammer in response to depression of the key, wherein the pressing surface and the to-be-pressed surface have relatively-concaved shapes in a longitudinal direction of the hammer, and an inclination caused by an overall curvature of the switch body that results from the fact that the switch body is pressed by the hammer from an oblique direction is canceled by an inclination of the switch body caused by partial compression and deformation that results from the relatively-concaved shapes when the switch body is pressed by the hammer, so that the plurality of movable contacts frontally face the plurality of stationary contacts and come into contact with the plurality of stationary contacts, respectively. With this configuration, it is possible to make excellent a contact state when the movable contacts of the switches in the switch body of the key switch come into contact with the stationary contacts, respectively, and it is possible to stabilize an electric touch sensing operation, and this effect is fulfilled conspicuously when the number of movable contacts is three or more and when the number of stationary contacts is three or more.

In addition, with the configuration that the pressing surface wholly come into close contact with the to-be-pressed surface before the plurality of movable contacts come into contact with the plurality of stationary contacts, respectively, it is possible to make constant a depression stroke until the movable contacts respectively come into contact with the stationary contacts while bringing the switch body into a stable state, regardless of a key depression speed.

DESCRIPTION OF EMBODIMENTS

The present invention will be hereinafter described with reference to FIG. 1 to FIG. 4. In FIG. 1 to FIG. 4, the same reference sign is given to a component that is equivalent to or corresponds to each component shown in FIG. 5 to FIG. 8.

Figure 1:
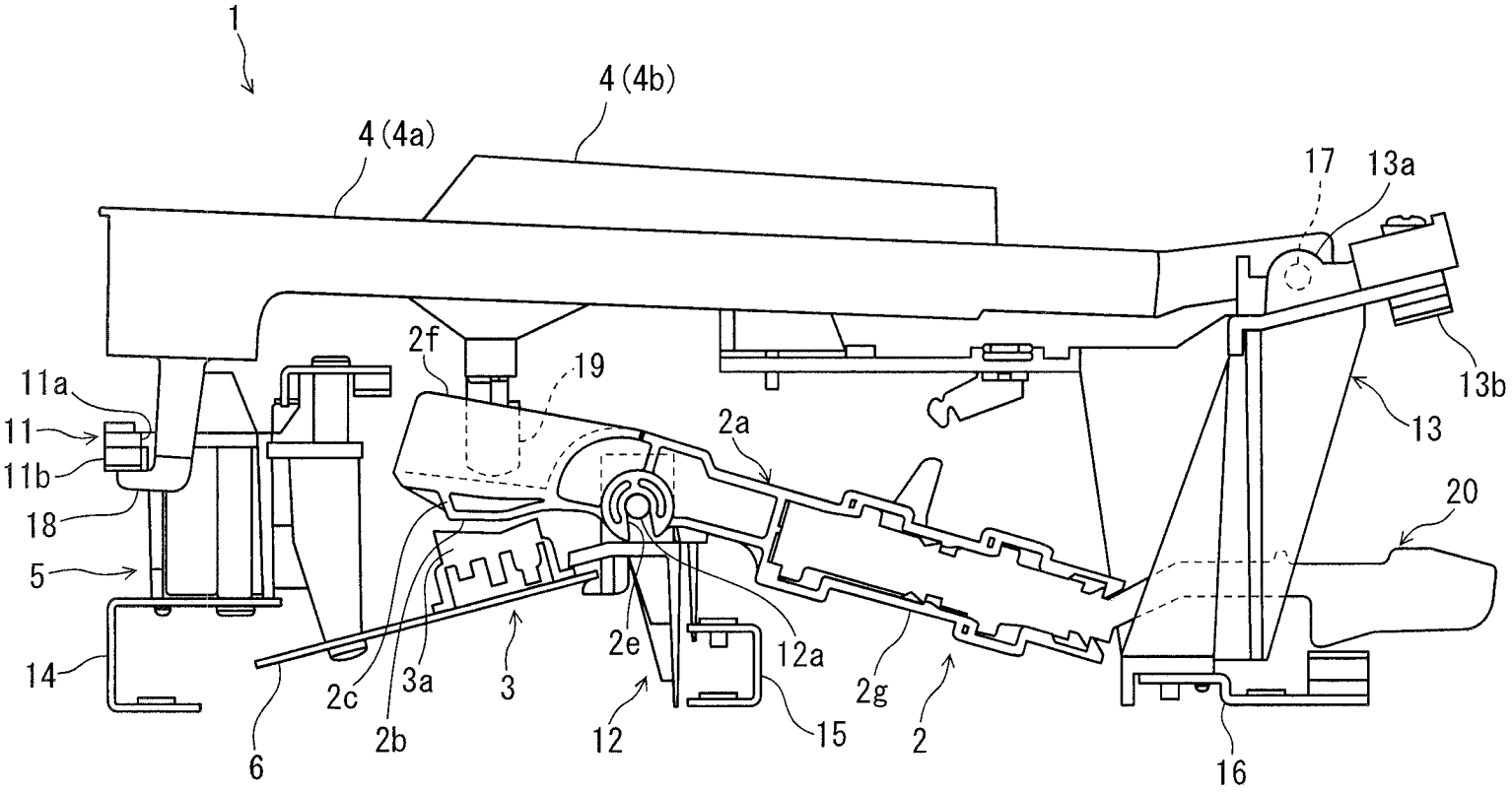
FIG. 1 is a sectional side view that shows an embodiment of a keyboard device for an electronic keyboard instrument of the present invention and that shows a case in which the electronic keyboard instrument is an electronic piano and is in a key-off state in which the key is not depressed.

FIG. 1 is a sectional side view that shows an embodiment of a keyboard device for an electronic keyboard instrument of the present invention and that shows a case in which the electronic keyboard instrument is an electronic piano and is in a key-off state in which the key is not depressed.

As shown in FIG. 1, a keyboard device 1 includes a hammer 2, a key switch 3, a key 4, and a keyboard chassis 5. The hammer 2 is rotatably attached to the keyboard chassis 5, and the key 4 is swingably attached to the keyboard chassis 5. For example, eighty-eight keys each of which is the key 4 (white key 4*a*, black key 4*b*) are disposed in a direction of its arrangement (in a direction perpendicular to the plane of paper). A set of the hammer 2 and the key switch 3 is provided for the single white key 4*a*, and a set of the hammer 2 and the key switch 3 is provided for the single black key 4*b*.

Although a configuration with respect to the white key 4*a* will be described hereinafter, the same applies to a configuration with respect to the black key 4*b*.

The keyboard chassis 5 consists of a front chassis 11, an intermediate chassis 12, and a rear chassis 13. The chassis 11 to 13 are each made, for example, by injection molding of a synthetic resin (e.g., ABS resin), and are connected together by means of ribs that extend in a front-rear direction, and are fixedly placed on a key bed of the electronic piano through front, intermediate, and rear mounting rails 14 to 16 that extend in a right-left direction (in a direction in which the keys are arranged).

The front chassis 11 has two right and left engagement holes 11*a* passing through the front chassis 11 in an up-down direction that are bored for each white key 4*a*, and a key stopper 11*b* made of felt or the like is attached to a lower surface of a front-side portion of the engagement holes 11*a*.

The intermediate chassis 12 is provided with a shaft-shaped hammer fulcrum 12*a* that supports the hammer 2 and that protrudes both rightwardly and leftwardly.

The rear chassis 13 is provided with a shaft-hole-shaped key fulcrum 13*a* that supports the white key 4*a*, and a hammer stopper 13*b* made of felt or the like is attached to a lower surface of a rear-side portion of the key fulcrum 13*a*.

The white key 4*a* is formed in a hollow shape that is open downwardly, for example, by injection molding of a synthetic resin (e.g., AS), and extends forwardly. A rear end portion of the white key 4*a* is provided with a fulcrum shaft 17 that protrudes both rightwardly and leftwardly, and the white key 4*a* is swingably supported by the rear chassis 13 by allowing the fulcrum shaft 17 to engage the key fulcrum 13*a*.

A left-right pair of hook portions 18 are disposed at a front end portion of the white key 4*a*, and the hook portions 18 extend downwardly from left and right sidewalls through the engagement holes 11*a* of the front chassis 11, respectively, and bend forwardly from a lower end of each engagement hole 11*a*.

In the key-off state of the white key 4*a*, the hook portion 18 is brought into contact with the key stopper 11*b* of the front chassis 11 from below, and an upper limit position of the white key 4*a* is restrained. An actuator portion 19 protruding downwardly is disposed on a lower surface of the white key 4*a*, at a more rearward position than the hook portion 18.

The hammer 2 is composed of a hammer body 2*a* and a weight 20 attached to the hammer body 2*a*. The hammer body 2*a* is made, for example, by injection molding of a synthetic resin (e.g., POM (polyacetal)), and extends in the front-rear direction, and has a U-shaped shaft hole 2*e* that is open downwardly at a position slightly in front of a center of the hammer body 2*a*. The hammer 2 is rotatably supported by the intermediate chassis 12 by allowing the shaft hole 2*e* to engage the hammer fulcrum 12*a*.

An engagement concave portion 2*f* that is open upwardly and forwardly is formed at a more forward side than the shaft hole 2*e* of the hammer body 2*a*. The actuator portion 19 of the white key 4*a* is housed in the engagement concave portion 2*f*, and is brought into contact with a bottom of the engagement concave portion 2*f*. A switch pressing portion 2*c* to press the key switch 3 is formed on the key-switch side of the engagement concave portion 2*f* of the hammer body 2*a*, and has a convex pressing surface 2*b* that is gently curved downwardly.

One side of a rear half portion of the hammer body 2*a* is a weight-attached portion 2*g*, to which the weight 20 is detachably attached. The weight 20 is made of a metallic plate of, for example, iron that is larger in specific gravity than the hammer body 2*a*, and is formed in a predetermined shape by, for example, press working. The weight 20 extends in the front-rear direction, and is attached to the weight-attached portion 2*g* of the hammer body 2*a* in its front half portion, and protrudes rearwardly from the weight-attached portion 2*g*, and extends to the vicinity of a rear end of the rear chassis 13.

The key switch 3 includes a printed circuit board (substrate) 6 and a switch body 3 attached to the printed circuit board 6 with respect to the white key 4. The printed-circuit board 6 has a front end portion screwed to the front chassis 11 in a state in which its rear end portion is inserted in the intermediate chassis 12, and the printed circuit board 6 extends in the right-left direction while inclining forwardly and downwardly.

Figure 2:
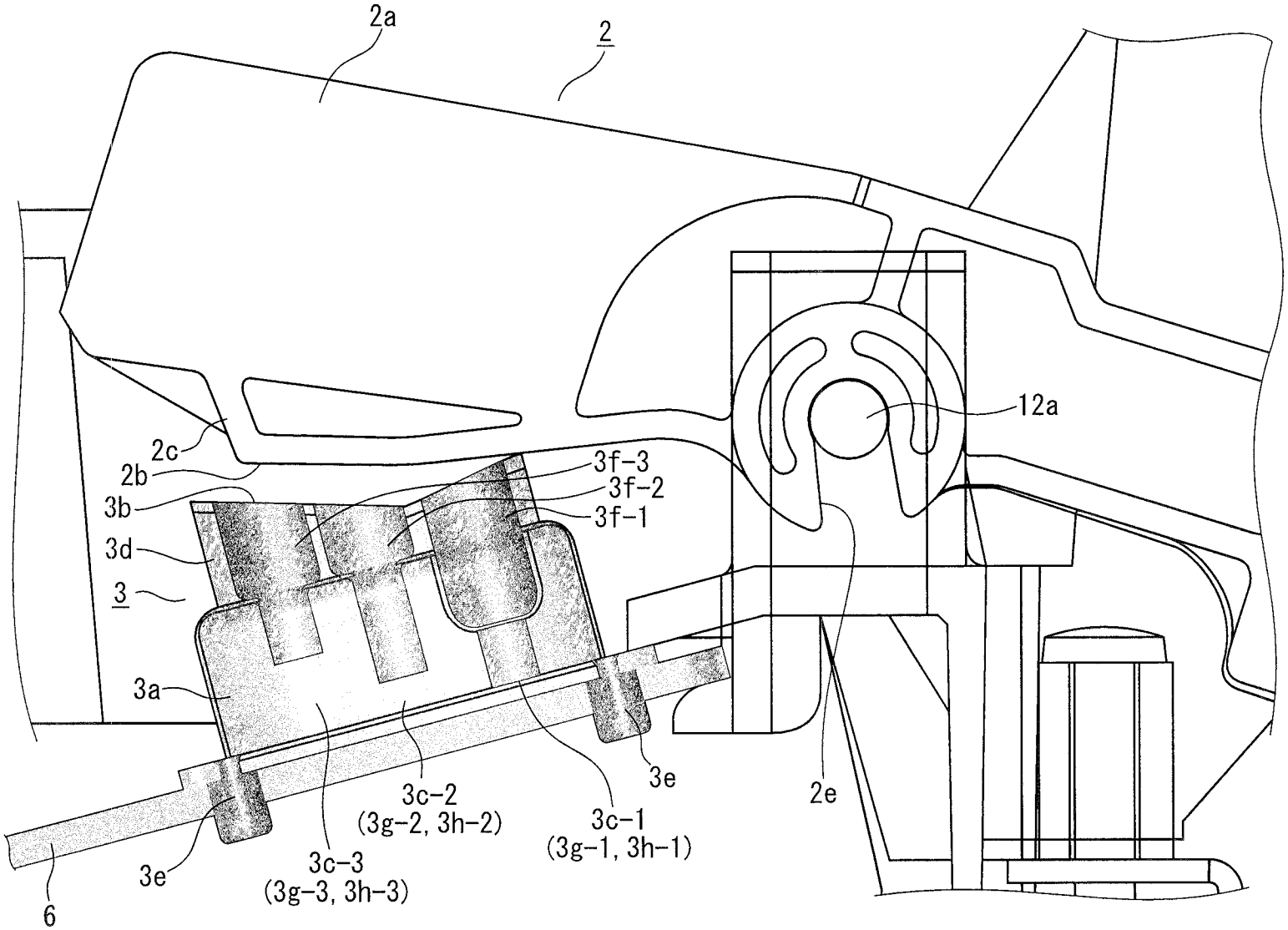
FIG. 2 is an enlarged, sectional side view that shows a hammer, a key switch, and its peripheral portion of the keyboard device of FIG. 1 and that shows a state when the hammer begins to come into contact with the key switch in response to the rotation of the hammer.
Figure 3:
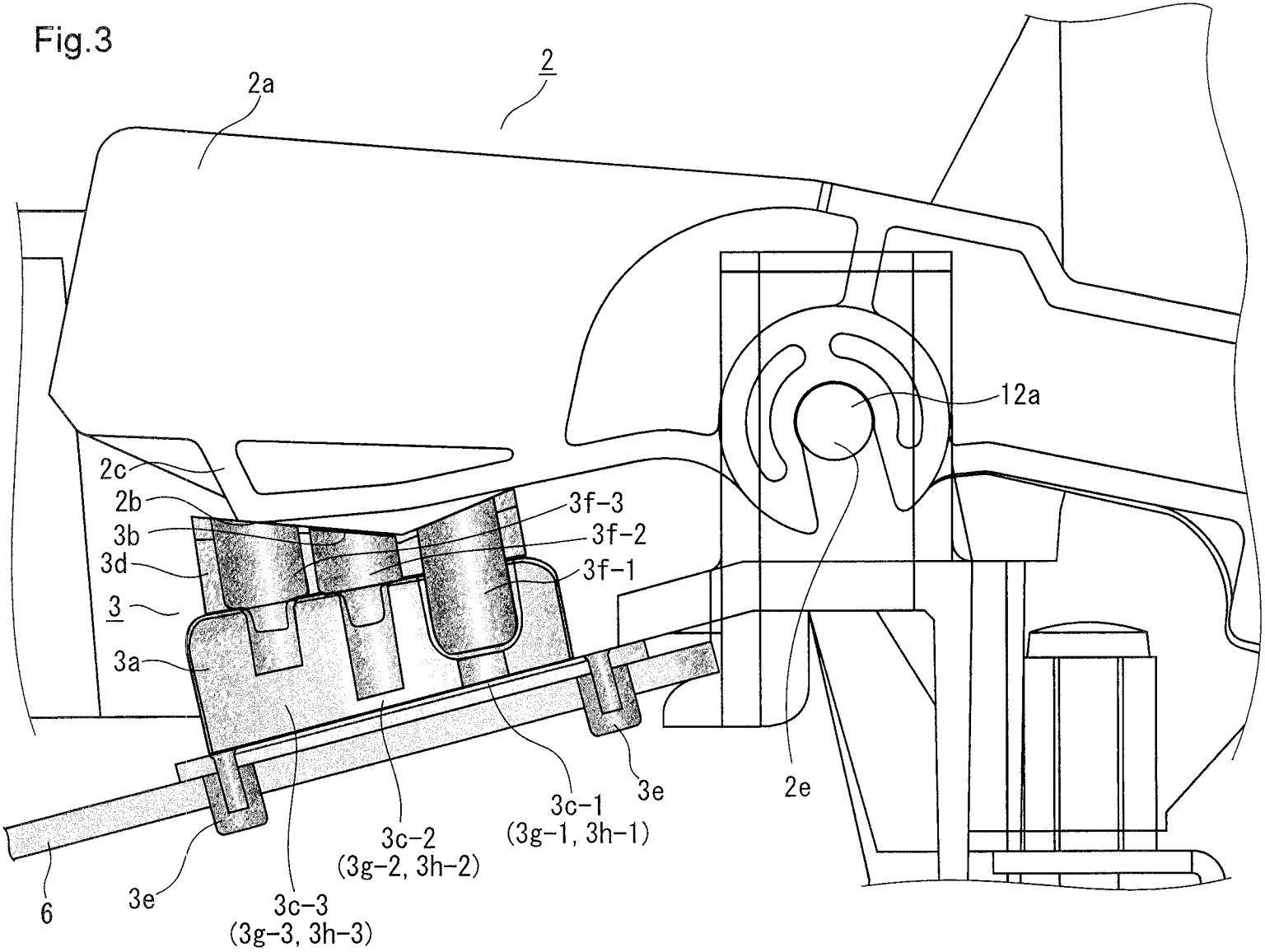
FIG. 3 is an enlarged, sectional side view that shows the hammer, the key switch, and its peripheral portion of the keyboard device of FIG. 1 and that shows a state when a front-end side of the hammer comes into contact with the key switch in response to the rotation of the hammer.
Figure 4:
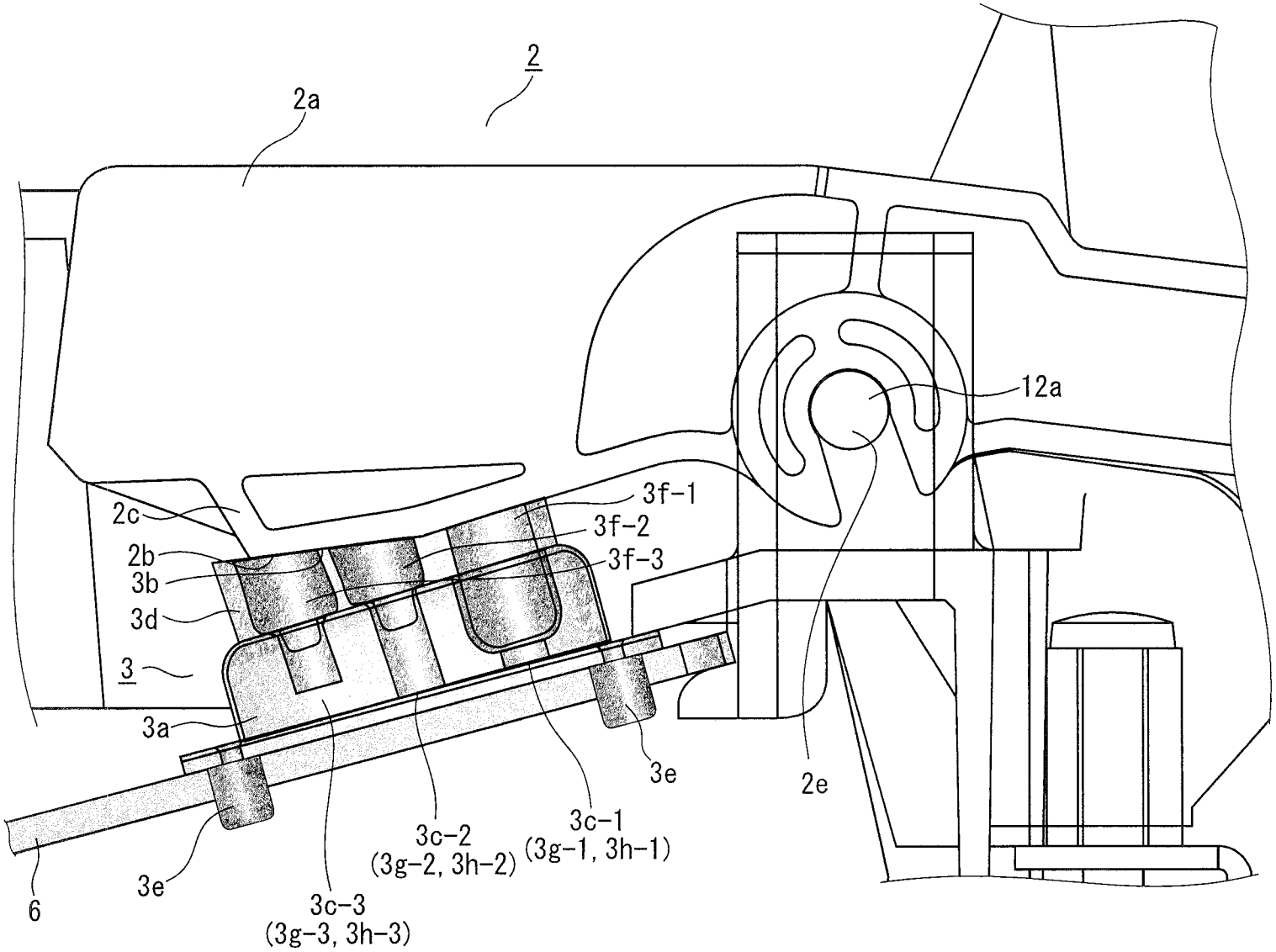
FIG. 4 is an enlarged, sectional side view that shows the hammer, the key switch, and its peripheral portion of the keyboard device of FIG. 1 and that shows a state when a pressing surface of the hammer comes into close contact with a to-be-pressed surface of the key switch and when the hammer presses the key switch as a whole.
Figure 5:
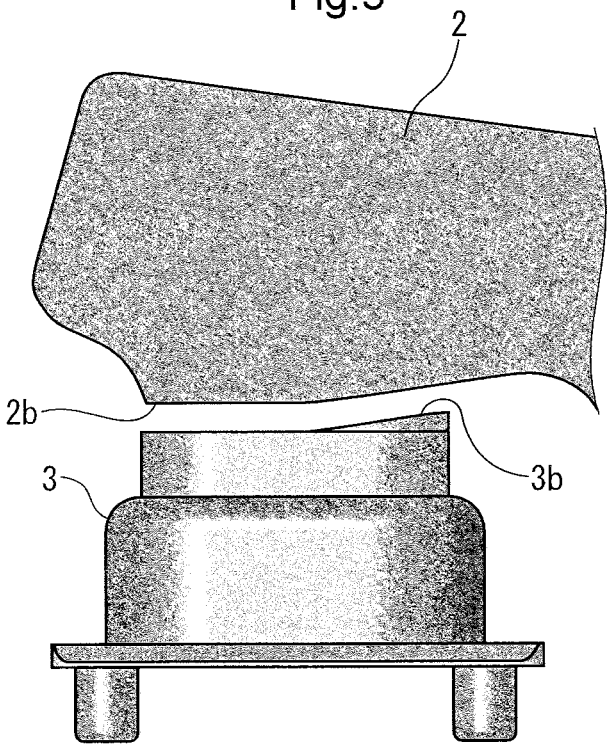
FIG. 5 is a descriptive view showing a positional relationship between a hammer and a key switch in a conventional key touch sensing configuration.

FIG. 2 to FIG. 4 are enlarged, sectional side views, each showing the hammer 2, the key switch 3, and its peripheral portion of the keyboard device 1 of FIG. 1.

Herein, FIG. 2 shows a state when the hammer 2 begins to come into contact with the key switch 3 in response to the rotation of the hammer 2, and FIG. 3 shows a state when the front-end side of the hammer 2 comes into contact with the key switch 3, and FIG. 4 shows a state when the hammer 2 wholly comes into close contact with the key switch 3 and presses the key switch 3. In the key-off state of the white key 4*a*, the hammer 2 is away from the key switch 3 and is above the key switch 3.

As shown in FIG. 2 to FIG. 4, the switch body 3*a* of the key switch 3 is formed in a hollow dome shape that is open downwardly with an elastic material, such as rubber, and integrally has a to-be-pressed portion having a to-be-pressed surface 3*b* and a peripheral wall portion 3*d*.

A plurality of bosses 3*e* are formed on a lower surface of the peripheral wall portion 3*d*, and the switch body 3*a* is attached to the printed circuit board 6 by inserting the bosses 3*e* into engagement holes of the printed circuit board 6. An upper surface of the switch body 3*a* of the key switch 3 is the to-be-pressed surface 3*b* that is pressed by the switch pressing portion 2*c* of the hammer 2.

Hereinafter, the to-be-pressed surface 3*b* of the to-be-pressed portion of the switch body 3*a* of the key switch 3 is referred to simply as the "to-be-pressed surface 3*b*," and the pressing surface 2*b* of the switch pressing portion 2*c* of the hammer 2 is referred to simply as the "pressing surface 2*b*."

The to-be-pressed surface 3*b* and the pressing surface 2*b* are not identical in shape with each other although conventional ones are identical in shape with each other, and the to-be-pressed surface 3*b* and the pressing surface 2*b* have relatively-concaved shapes in a longitudinal direction of the hammer 2 (i.e., direction in which the fulcrum and the front end of the hammer 2 are connected together). The term "relatively concaved shape" denotes a shape in which the to-be-pressed surface 3*b* and the pressing surface 2*b* become loose at a center therebetween when the to-be-pressed surface 3*b* and the pressing surface 2*b* are fitted together.

First to third switches 3*c*-1 to 3*c*-3 for the single white key 4*a* are disposed in the switch body 3*a*, and respectively have first to third stationary contacts 3*g*-1 to 3*g*-3 formed on an upper surface of the printed circuit board 6 with predetermined intervals between the first to third switches 3*c*-1 to 3*c*-3 in order of distance away from the side closest to the hammer fulcrum 12*a*. The first to third stationary contacts 3*g*-1 to 3*g*-3 are covered with the switch body 3*a*.

First to third attaching portions 3*f*-1 to 3*f*-3 that extend toward the printed-circuit-board-6 side integrally with the switch body 3*a* are disposed inside the to-be-pressed surface 3*b* of the switch body 3*a*, and the first to third switches 3*c*-1 to 3*c*-3 are each made of an elastic material, such as rubber, in the same way as the switch body 3*a*, and are formed so that the first attaching portion 3*f*-1 is slightly longer than the second attaching portion 3*f*-2 and so that the second attaching portion 3*f*-2 is slightly longer than the third attaching portion 3*f*-3.

First to third movable contacts 3*h*-1 to 3*h*-3 are attached to front ends of the first to third attaching portions 3*f*-1 to 3*f*-3, respectively, and the first to third movable contacts 3*h*-1 to 3*h*-3 face the first to third stationary contacts 3*g*-1 to 3*g*-3 from above so as to be paired with the first to third stationary contacts 3*g*-1 to 3*g*-3, respectively.

The first switch 3*c*-1 consists of the first movable contact 3*h*-1 and the first stationary contact 3*g*-1, and the second switch 3*c*-2 consists of the second movable contact 3*h*-2 and the second stationary contact 3*g*-2, and the third switch 3*c*-3 consists of the third movable contact 3*h*-3 and the third stationary contact 3*g*-3.

Intervals between the first to third movable contacts 3*h*-1 to 3*h*-3 and the first to third stationary contacts 3*g*-1 to 3*g*-3 become larger in order of the first switch 3*c*-1, the second switch 3*c*-2, and the third switch 3*c*-3 by determining the lengths of the first to third attaching portions 3*f*-1 to 3*f*-3 as mentioned above. Therefore, in response to the rotation of the hammer 2, the first movable contact 3*h*-1 first comes into contact with the first stationary contact 3*g*-1, and then the second movable contact 3*h*-2 comes into contact with the second stationary contact 3*g*-2, and last the third movable contact 3*h*-3 comes into contact with the third stationary contact 3*g*-3.

Next, the operation of the keyboard device 1 of FIG. 1 will be described.

In the keyboard device 1, the hammer 2 is inclined rearwardly and downwardly because of the gravitational weight of the weight 20 as shown in FIG. 1 when the white key 4*a* is in a key-off state.

The white key 4*a* swings in a counterclockwise direction of FIG. 1 in response to depression of the white key 4*a*, and the actuator portion 19 pushes the bottom of the engagement concave portion 2*f* of the hammer 2 downwardly, and the hammer 2 rotates in the counterclockwise direction.

The hammer 2 rotates while following the circular arc locus centering on the hammer fulcrum 12*a*, and hence is first brought into contact with the switch body 3*a* at the first-movable-contact-3*h*-1 side close to the hammer fulcrum 12*a*. FIG. 2 shows a state at this time.

When the hammer 2 further rotates in accordance with the depression stroke of the depression of the white key 4*a*, a part of the switch body 3*a* at the first-movable-contact 3*h*-1 side is chiefly pressed by the hammer 2, and is compressed and deformed, and is inclined inwardly because the pressing surface 2*b* and the to-be-pressed surface 3*b* have relatively-concaved shapes in the longitudinal direction of the hammer 2.

This partial inclination of the switch body 3*a* cancels an inclination caused by the overall curvature of the switch body 3*a* that results from the fact that the switch body 3*a* is pressed by the hammer 2 from an oblique direction, and, when the first movable contact 3*h*-1 comes into contact with the first stationary contact 3*g*-1, the first movable contact 3*h*-1 frontally faces the first stationary contact 3*g*-1 and then comes into contact therewith. Hence, it is possible to allow the first movable contact 3*h*-1 to frontally face the first stationary contact 3*g*-1 and then come into contact therewith at an early stage of the depression stroke when the white key 4*a* is depressed.

When the hammer 2 further rotates in accordance with the depression stroke of the depression of the white key 4*a*, the front-end side of the hammer 2 also comes into contact with the key switch 3 at the third-movable-contact 3*h*-3 side farther from the hammer fulcrum 12*a*. A center portion between the fulcrum side and the front-end side of the hammer 2 does not come into contact with the key switch 3 because the pressing surface 2*b* and the to-be-pressed surface 3*b* have relatively-concaved shapes in the longitudinal direction of the hammer 2. FIG. 3 shows a state at this time.

When the hammer 2 further rotates in accordance with the depression stroke of the depression of the white key 4*a*, a part of the switch body 3*a* at the third-movable-contact 3*h*-3 side is pressed and is then compressed and deformed, and is partially inclined outwardly.

When the hammer 2 further rotates in accordance with the depression stroke of the depression of the white key 4*a*, the pressing surface 2*b* comes into close contact with the to-be-pressed surface 3*b*, and the hammer 2 presses the key switch 3 as a whole. FIG. 4 shows a state in which the pressing surface 2*b* comes into close contact with the to-be-pressed surface 3*b*, and the hammer 2 then presses the key switch 3 as a whole, and the second movable contact 3*h*-2 comes into contact with the second stationary contact 3*g*-2.

Although the third movable contact 3*h*-3 has not yet come into contact with the third stationary contact 3*g*-3 in the state shown in FIG. 4, the third movable contact 3*h*-3 will come into contact with the third stationary contact 3*g*-3 if the hammer 2 further rotates in accordance with the depression stroke of the depression of the white key 4*a*.

The interval between the first movable contact 3*h*-1 and the first stationary contact 3*g*-1, the interval between the second movable contact 3*h*-2 and the second stationary contact 3*g*-2, and the interval between the third movable contact 3*h*-3 and the third stationary contact 3*g*-3 become larger in this order as described above, and therefore the first movable contact 3*h*-1, the second movable contact 3*h*-2, and the third movable contact 3*h*-3 come into contact with the first stationary contact 3*g*-1, the second stationary contact 3*g*-2, and the third stationary contact 3*g*-3 in this order.

Likewise, in a process in which the second movable contact 3*h*-2 comes into contact with the second stationary contact 3*g*-2, and furthermore the third movable contact 3*h*-3 comes into contact with the third stationary contact 3*g*-3 in accordance with the depression stroke of the depression of the white key 4*a* as shown in FIG. 4, the switch body 3*a* is partially compressed and deformed, and is inclined when the switch body 3*a* is pressed by the hammer 2 because the pressing surface 2*b* and the to-be-pressed surface 3*b* have relatively-concaved shapes in the longitudinal direction of the hammer 2, and this inclination cancels an inclination caused by the overall curvature of the switch body 3*a* that results from the fact that the switch body 3*a* is pressed by the hammer 2 from an oblique direction, and, when the second movable contact 3*h*-2 and the third movable contact 3*h*-3 come into contact with the second stationary contact 3*g*-2 and the third stationary contact 3*g*-3, respectively, these movable contacts frontally face these stationary contacts, and come into contact therewith, respectively.

Thereafter, when a rear end portion of the hammer 2 is brought into contact with the hammer stopper 13*b*, the rotation of the hammer 2 is stopped.

On the other hand, when the white key 4*a* is released from being depressed, the hammer 2 rotates in a clockwise direction of FIG. 1. The white key 4*a* is pushed up through the actuator portion 19, and swings in the clockwise direction in response to the rotation of the hammer 2, and the hook portion 18 is brought into contact with the key stopper 11*b*, and the swing of the white key 4*a* is stopped. Hence, the white key 4*a* and the hammer 2 return to the key-off state of the white key 4*a* as shown in FIG. 1.

Although FIG. 2 to FIG. 4 show that the first movable contact 3*h*-1 comes into contact with the first stationary contact 3*g*-1 before the pressing surface 2*b* of the hammer 2 wholly comes into close contact with the to-be-pressed surface 3*b* of the key switch 3, it is also preferable to allow the pressing surface 2*b* of the hammer 2 to wholly come into close contact with the to-be-pressed surface 3*b* of the key switch 3 before the first movable contact 3*h*-1 comes into contact with the first stationary contact 3*g*-1. In this case, it is possible to make the switch body 3*a* stable by wholly bringing the pressing surface 2*b* into close contact with the to-be-pressed surface 3*b*, and therefore it is possible to make constant the depression stroke until the first to third movable contacts 3*h*-1 to 3*h*-3 come into contact with the first to third stationary contacts 3*g*-1 to 3*g*-3, respectively, regardless of the key depression speed.

Although the embodiment of the present invention has been described as above, the present invention is not limited to the aforementioned embodiment, and can be embodied in various modes within the range of the technical thought of the present invention.

For example, although the electronic keyboard instrument is an electronic piano in the aforementioned embodiment, the present invention is effective even in a case in which any electronic keyboard instrument except the electronic piano is used.

Additionally, the key switch is merely required to have a plurality of switches, and the effect of the present invention can be more excellently fulfilled if the key switch has three switches or more.

Figure 6:
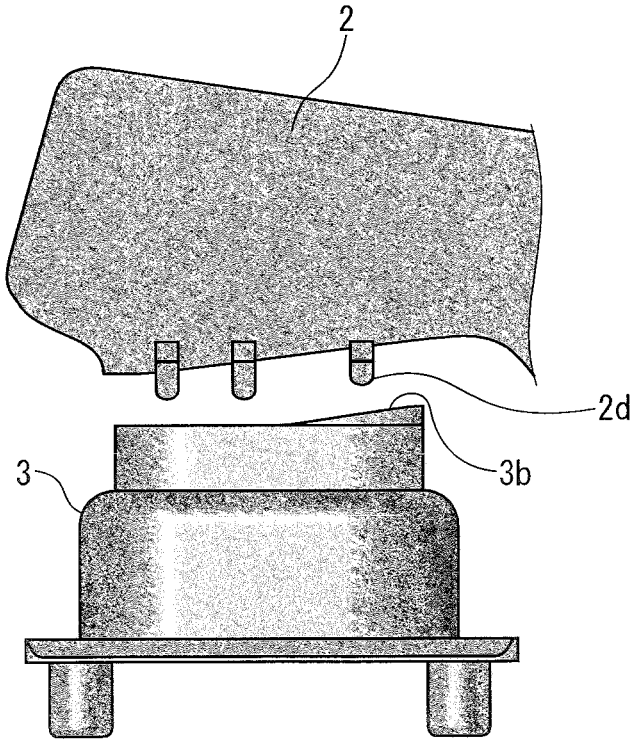
FIG. 6 is a descriptive view showing a positional relationship between a hammer and a key switch in a configuration in which the hammer has ribs.
Figure 7:
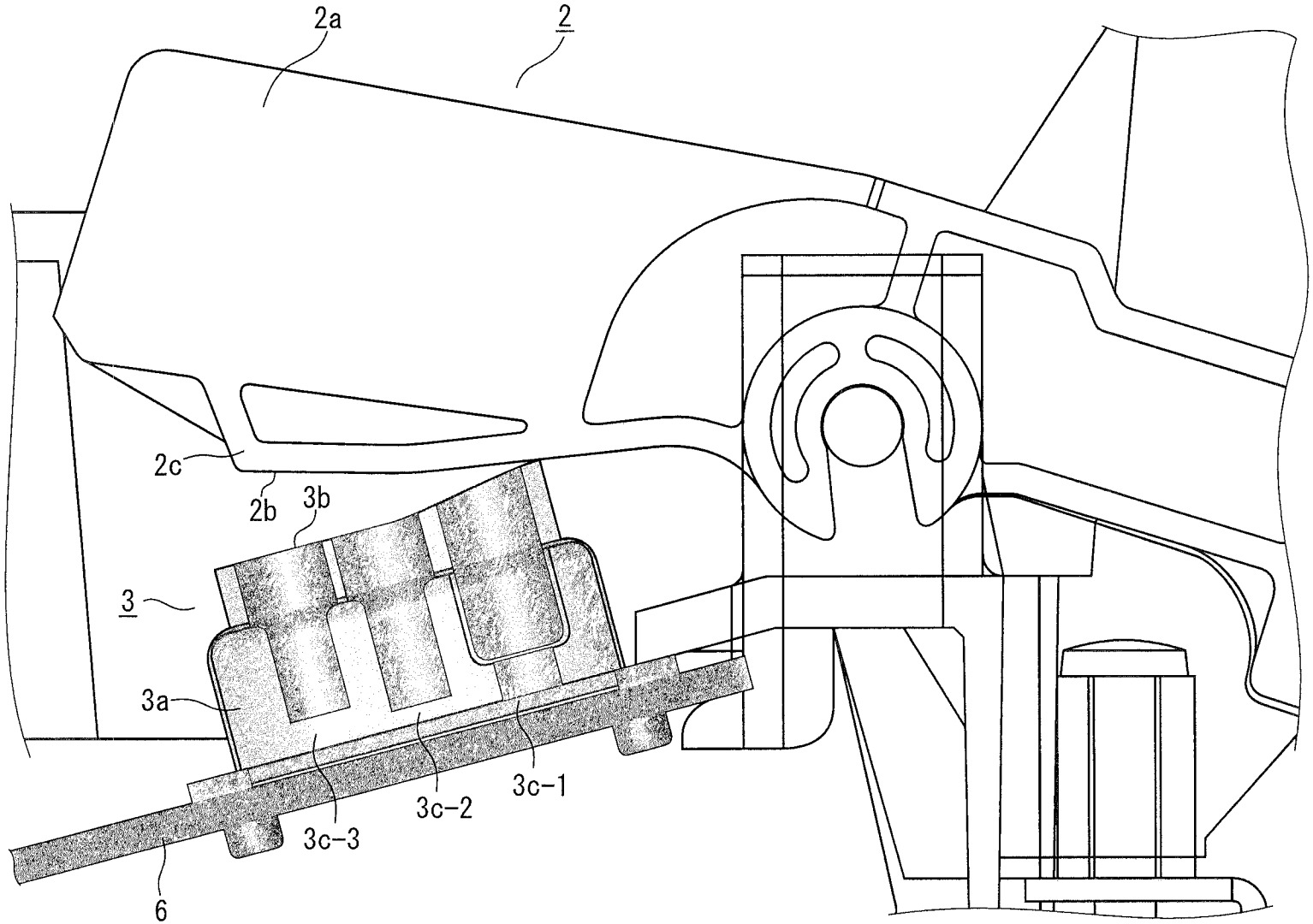
FIG. 7 is an enlarged, sectional side view that shows a hammer, a key switch, and its peripheral portion of a conventional keyboard device and that shows a state when the hammer rotating while following a circular arc locus begins to come into contact with the key switch.
Figure 8:
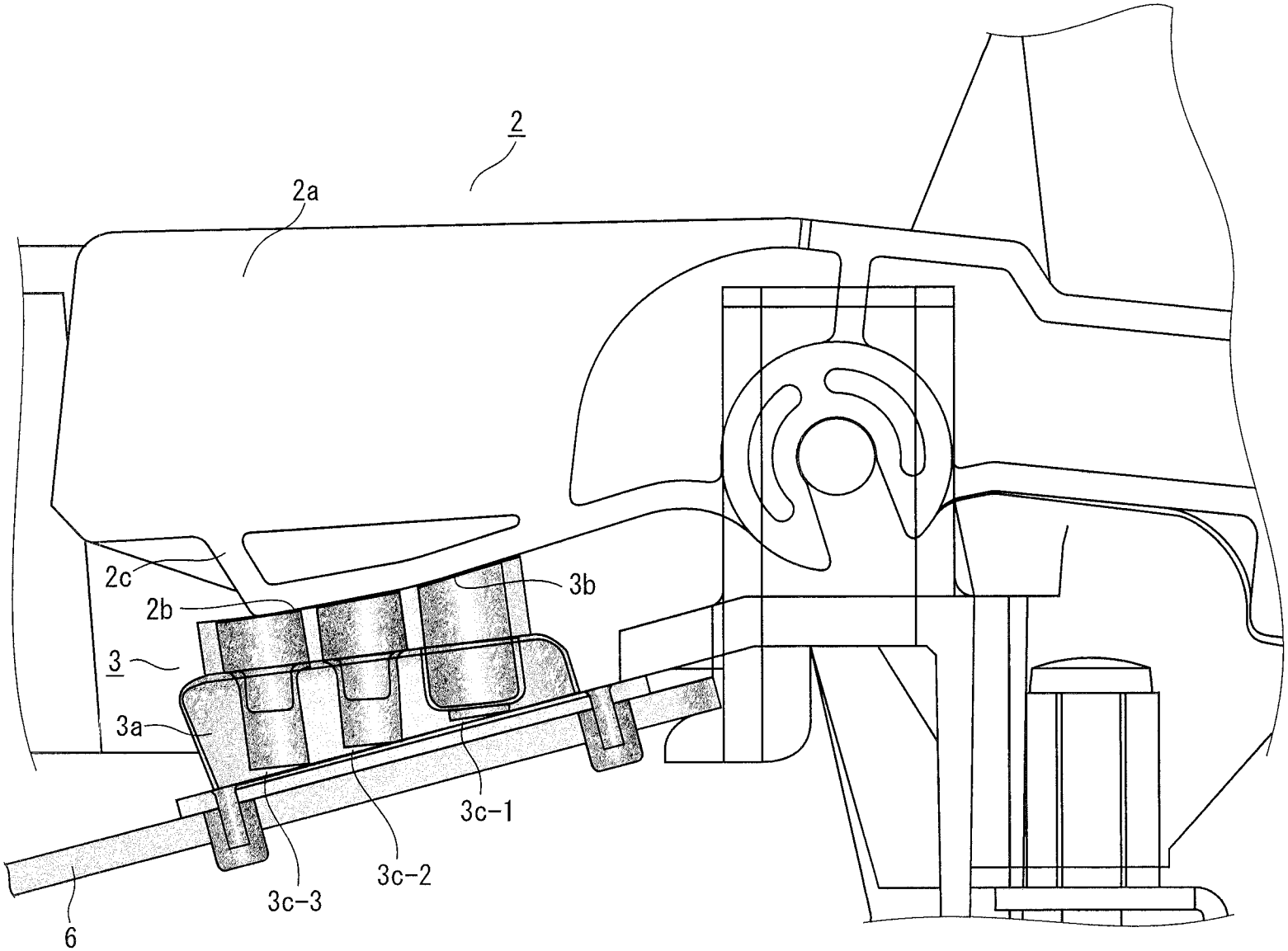
FIG. 8 is an enlarged, sectional side view that shows a hammer, a key switch, and its peripheral portion of a conventional keyboard device and that shows a state when a switch body pressed by the hammer curves as a whole and is inclined, and hence movable contacts of the switches in the switch body obliquely come into contact with stationary contacts, respectively.

Additionally, the hammer may have ribs as shown in FIG. 6, and the pressing surface of the hammer or the to-be-pressed surface of the key switch is merely required to have a relatively-concaved shape in the longitudinal direction of the hammer, and its shape is arbitrary as far as it goes. Additionally, although the key switch is placed below the hammer in FIG. 1 to FIG. 4, the disposition or configuration of those components is also arbitrary. Besides, detailed configurations of the keyboard device can be appropriately changed.

REFERENCE SIGNS LIST

1 . . . keyboard device, 2 . . . hammer, 2*a* . . . hammer body, 2*b* . . . pressing surface, 2*c* . . . switch pressing portion, 2*d* . . . rib, 2*e* . . . shaft hole, 2*f* . . . engagement concave portion, 2*g* . . . weight-attached portion, 3 . . . key switch, 3*a* . . . switch body, 3*b* . . . to-be-pressed surface, 3*c*-1~3*c*-3 . . . switch, 3*d* . . . peripheral wall portion, 3*e* . . . boss, 3*f*-1~3*f*-3 . . . attaching portions, 3*g*-1~3*g*-3 . . . stationary contact, 3*h*-1~3*h*-3 . . . • movable contact, 4 . . . key, 4*a* . . . white key, 4*b* . . . black key, 5 . . . keyboard chassis, 6 . . . printed circuit board, 11 . . . front chassis, 11*a* . . . engagement hole, 11*b* . . . key stopper, 12 . . . intermediate chassis, 12*a* . . . hammer fulcrum, 13 . . . rear chassis, 13*a* . . . key fulcrum, 13*b* hammer stopper, 14~16 . . . mounting rail, 17 . . . fulcrum shaft, 18 . . . hook portion, 19 . . . actuator portion, 20 . . . weight.

What is claimed is:

1. A keyboard device for an electronic keyboard instrument, the keyboard device comprising:

a swingable key;

a hammer that has a pressing surface having a predetermined shape and that rotates while following a circular arc locus in response to depression of the key; and a key switch to detect key depression information on the key, the key switch comprising:

a substrate on which a plurality of stationary contacts are disposed;

a hollow switch body that has a to-be-pressed surface, that is made of an elastic material, and that is attached to the substrate so as to cover the plurality of stationary contacts; and a plurality of movable contacts that are disposed inside the switch body, that respectively face the plurality of stationary contacts with mutually different intervals, and that respectively come into contact with the plurality of stationary contacts in order when the switch body is pressed by the hammer in response to depression of the key, wherein the pressing surface and the to-be-pressed surface have relatively-concaved shapes in a longitudinal direction of the hammer, wherein the relatively-concaved shape is a shape in which the to-be-pressed surface and the pressing surface become loose at a center therebetween when the to-be-pressed surface and the pressing surface a fitted together, and an inclination caused by an overall curvature of the switch body that results from the fact that the switch body is pressed by the hammer from an oblique direction after the hammer begins to come into contact with the switch body is canceled by an inclination of the switch body caused by partial compression and deformation that results from the relatively-concaved shapes when the switch body is pressed by the hammer, so that the plurality of movable contacts frontally face the plurality of stationary contacts and come into contact with the plurality of stationary contacts, respectively.

2. The keyboard device for an electronic keyboard instrument according to claim 1, wherein the pressing surface wholly come into close contact with the to-be-pressed surface before the plurality of movable contacts come into contact with the plurality of stationary contacts, respectively.

3. The keyboard device for an electronic keyboard instrument according to claim 1, wherein the plurality of movable contacts are three or more in number, and the plurality of stationary contacts are three or more in number.

4. The keyboard device for an electronic keyboard instrument according to claim 2, wherein the plurality of movable contacts are three or more in number, and the plurality of stationary contacts are three or more in number.

5. The keyboard device for an electronic keyboard instrument according to claim 1, wherein the hammer has ribs on a side of the switch body.

6. The keyboard device for an electronic keyboard instrument according to claim 2, wherein the hammer has ribs on a side of the switch body.

7. The keyboard device for an electronic keyboard instrument according to claim 3, wherein the hammer has ribs on a side of the switch body.

8. The keyboard device for an electronic keyboard instrument according to claim 4, wherein the hammer has ribs on a side of the switch body.

* * * * *